US007593681B2

(12) United States Patent
Tamemasa et al.

(10) Patent No.: US 7,593,681 B2
(45) Date of Patent: Sep. 22, 2009

(54) LAMINATED BODY, ENDLESS BELT, FIXING DEVICE, AND IMAGE FORMING DEVICE

(75) Inventors: Hiroshi Tamemasa, Kanagawa (JP); Motofumi Baba, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 231 days.

(21) Appl. No.: 11/802,393

(22) Filed: May 22, 2007

(65) Prior Publication Data

US 2008/0145116 A1 Jun. 19, 2008

(30) Foreign Application Priority Data

Dec. 13, 2006 (JP) ..... 2006-335343

(51) Int. Cl.
*G03G 15/20* (2006.01)

(52) U.S. Cl. ..... 399/333; 219/216; 399/329

(58) Field of Classification Search ..... 399/328, 399/329, 330, 331, 333, 307; 219/216, 619; 347/156
See application file for complete search history.

(56) References Cited

U.S. PATENT DOCUMENTS

| | | | | |
|---|---|---|---|---|
| 5,568,240 | A | 10/1996 | Ohtsuka | |
| 6,795,679 | B2 | 9/2004 | Shimizu et al. | |
| 2004/0105708 | A1 | 6/2004 | Imai et al. | |
| 2006/0165444 | A1* | 7/2006 | Nanjo et al. | 399/328 |
| 2006/0216080 | A1* | 9/2006 | Nanjo | 399/333 |
| 2007/0110467 | A1* | 5/2007 | Ohno et al. | 399/70 |
| 2007/0127959 | A1* | 6/2007 | Tatematsu et al. | 399/329 |
| 2008/0057335 | A1* | 3/2008 | Tamemasa | 399/329 X |
| 2008/0063445 | A1* | 3/2008 | Imai et al. | 399/333 |

FOREIGN PATENT DOCUMENTS

| | | |
|---|---|---|
| CN | 1504065 A | 6/2004 |
| JP | B2 5-9027 | 2/1993 |
| JP | A 7-114276 | 5/1995 |
| JP | A 2003-131507 | 5/2003 |
| JP | A 2003-223063 | 8/2003 |
| JP | A 2003-233260 | 8/2003 |

* cited by examiner

*Primary Examiner*—Sophia S Chen
(74) *Attorney, Agent, or Firm*—Oliff & Berridge, PLC

(57) ABSTRACT

A laminated body has a heat generating layer having crystal grains of a first non-magnetic metal, and a base layer containing a second non-magnetic metal that is different from the first non-magnetic metal.

20 Claims, 4 Drawing Sheets

LAMINATED BODY, ENDLESS BELT, FIXING DEVICE, AND IMAGE FORMING DEVICE

CROSS-REFERENCE TO RELATED APPLICATION

This application is based on and claims priority under 35 USC 119 from Japanese Patent Application No. 2006-335343 filed on Dec. 13, 2006.

BACKGROUND

1. Technical Field

The present invention relates to a laminated body, an endless belt, a fixing device, and an image forming device.

2. Related Art

In an electrophotographic image forming device using dry toner, for a fixing device which fixes a toner image onto the surface of a recording medium by heating and pressurizing, fixing rollers provided with a toner releasing layer on the outer peripheral face of a core metal and a heating halogen heater inside the core metal, have conventionally been used.

SUMMARY

According to an aspect of the invention, there is provided a laminated body comprising a heat generating layer having crystal grains of a first non-magnetic metal, and a base layer having a second non-magnetic metal which is different from the first non-magnetic metal.

BRIEF DESCRIPTION OF THE DRAWINGS

Exemplary embodiments of the present invention will be described in detail based on the following figures, wherein.

DETAILED DESCRIPTION

Hereunder is a detailed description of the present invention.

<Laminated Body>

A laminated body of the present invention comprises, at least, a heat generating layer having crystal grains of a first non-magnetic metal, and a base layer containing a second non-magnetic metal which is different from the first non-magnetic metal.

Hereunder is a description of the structure of the laminated body of the present invention.

Figure 1:
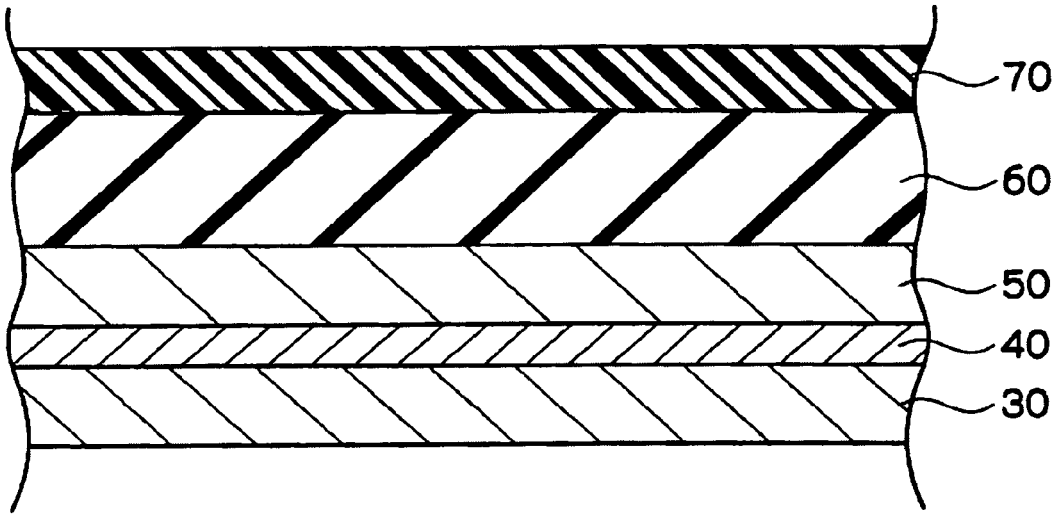
FIG. 1 is a schematic cross-section showing an example of a laminated body of the present invention.

FIG. 1 is a schematic cross-section showing an example of the structure of the laminated body of the present invention, showing a 5-layered laminated body. The laminated body comprises a 5-layer structure wherein a base layer 30, a heat generating layer 40, a protective layer 50, an elastic layer 60, and a resin layer 70 are provided sequentially from the bottom in FIG. 1. The structure shown in FIG. 1 is an example of the laminated body of the present invention, and may also be a form where the protective layer 50, the elastic layer 60, and the resin layer 70 are not formed.

(Heat Generating Layer)

The heat generating layer 40 formed on one face of the base layer 30 is a layer which generates heat by producing eddy currents by means of electromagnetic induction. The heat generating layer 40 comprises a non-magnetic metal (this non-magnetic metal contained in the heat generating layer is referred to as "first non-magnetic metal" in the present invention) and crystal grains of the first non-magnetic metal are provided. Whether or not the crystal grains are provided, can be confirmed by observing the crystal structure of the heat generating layer 40 from the cross-section of the final laminated body, with an optical microscope or an electron microscope (such as a scanning electron microscope (SEM)).

Here, if the heat generating layer is formed by utilizing plastic deformation, crystal grains can be confirmed in the cross-section, and the metal crystals are arranged in the surface direction (orthogonal direction to the thickness direction). More specifically, crystal grains are arranged in a state where they are squashed and flattened in the surface direction by the plastic deformation. On the other hand, for example, if the layer is formed by plating, in the cross-section, metal crystals are arranged in the thickness direction (parallel direction to the thickness direction), and the difference can be confirmed by the above observation. The surface direction means a direction forming an angle of 0° or more but less than 45° with the metal plate surface, and the thickness direction means a direction forming an angle of 45° or more but 90° or less with the metal plate surface.

Moreover, regarding metal layers other than the heat generating layer (such as the base layer containing the second non-magnetic metal and the protective layer containing a third non-magnetic metal described later), if the layer is formed by utilizing plastic deformation, crystal grains can be confirmed in the cross-section, and the metal crystals are arranged in the surface direction.

The material of the heat generating layer 40 is selected according to the application of the laminated body, and other than that it contains the non-magnetic metal (first non-magnetic metal), it is not specifically limited. However, a material having an intrinsic resistivity value of $2.7\times10^{-6}$ Ωm or less when formed in a layer, is preferably used. The intrinsic resistivity value is more preferably $1.0\times10^{-6}$ Ωm or more and $2.5\times10^{-6}$ Ωm or less, and particularly preferably $1.2\times10^{-6}$ Ωm or more and $2.2\times10^{-6}$ Ωm or less.

The intrinsic resistivity value can be measured by the following method.

The measurement of the intrinsic resistivity value is based on JIS-C2525 (1999) "Testing method for conductor-resistance and volume resistivity of metallic resistance materials", using a resistivity processor (Σ-5) manufactured by NPS, Inc., where a measurement target sample is mounted on the sample stage of this processor, and is pressed by a four point probe, and thereby the sample resistivity can be measured by a DC four point method.

The intrinsic resistivity value in the present description is measured by the above measuring method. Moreover, the intrinsic resistivity value of layers other than the heat generating layer 40 can be also measured by the above method.

Preferably, the non-magnetic metal (first non-magnetic metal) used for the heat generating layer 40 is at least one type of metal material selected from gold, silver, copper, aluminum, zinc, tin, lead, bismuth, beryllium, antimony, and an alloy containing these. Among them, gold, silver, copper, aluminum, and an alloy containing these are particularly preferred.

The thickness of the heat generating layer 40 is preferably in a range of 5 to 20 μm, more preferably in a range of 7 to 15 μm, and particularly preferably in a range of 8 to 12 μm.

The above layer thickness can be calculated by the following method.

The measurement of the layer thickness can be confirmed by observing the cross-section of the laminated body with an optical microscope or an electron microscope (such as a scanning electron microscope (a SEM, Trade Name T-200 manufactured by Japan Electron Ltd., is used in the present application)). The layer thickness is measured in 36 points (total 36 points=4 points×9 points, particularly in the case of an endless belt) per one heat generating layer, to obtain the average value, which is used as the layer thickness.

The layer thickness value of each layer in the present description is calculated by the above calculation method.

(Base Layer)

On one face of the heat generating layer 40 is provided the base layer 30 containing a non-magnetic metal (the non-magnetic metal contained in the base layer is referred to as the "second non-magnetic metal" in the present invention) which is different from the metal used for the heat generating layer 40. The base layer 30 is provided in order to prevent cracking occurrence in the heat generating layer 40, and has a lower efficiency in heat generation by means of electromagnetic induction than that of the heat generating layer 40.

Moreover, the material of the base layer 30 is selected according to the application of the laminated body, and is not specifically limited. However, a material having an intrinsic resistivity value of more than $2.7\times10^{-6}$ Ωm when formed in a layer, is preferably used. The intrinsic resistivity value is more preferably $5.0\times10^{-6}$ Ωm or more and $5.0\times10^{-5}$ Ωm or less, and particularly preferably $7.0\times10^{-6}$ Ωm or more and $3.0\times10^{-5}$ Ωm or less. The intrinsic resistivity value of the base layer 30 can be measured by the abovementioned measuring method for the heat generating layer 40.

Preferably, the non-magnetic metal (second non-magnetic metal) used for the base layer 30 is at least one type of metal material selected from stainless steel, and an alloy containing stainless steel.

The thickness of the base layer 30 is preferably in a range of 5 to 100 μm, and more preferably in a range of 10 to 70 μm. The layer thickness of the base layer 30 can be calculated by the abovementioned calculation method for the heat generating layer 40.

(Protective Layer)

In the laminated body, the protective layer 50 may be formed on the surface of the heat generating layer 40 that is opposite to the surface provided with the base layer 30 shown in FIG. 1. The protective layer 50 preferably contains a non-magnetic metal (the non-magnetic metal contained in the protective layer is referred to as the "third non-magnetic metal" in the present invention) which is different from the non-magnetic metal used for the heat generating layer 40.

Preferably, the intrinsic resistivity value of the protective layer 50 is in the same range as the preferable range of the intrinsic resistivity value of the base layer 30. Moreover, examples of the non-magnetic metal (third non-magnetic metal) used for the protective layer 50 may include the same materials used for the base layer 30. Furthermore, the thickness of the protective layer 50 is preferably in the same range as the preferable range of the thickness of the base layer 30.

(Formation of Base Layer, Heat Generating Layer, and Protective Layer)

The form of the base layer 30, the heat generating layer 40, and the protective layer 50 is not specifically limited, and may be formed in any form such as a plate form, a sheet form, a film form, and a cylindrical form. As to the forming method for these respective layers, firstly, metal plates required for the respective layers are prepared, and respective bonding faces of the respective metal plates are ground to remove the oxide coating. Then, using a working (rolling) method by means of plastic deformation in a cold or hot state, the respective metal plates are bonded, to produce a multi-layered metal plate having a required thickness. During the process of the plastic deformation working, or after the working, an annealing step may also be provided to reduce the working distortion occurring in the metal plates. Next, the multi-layered metal plate is worked by a deep drawing method, a spinning method, a pressing method, a rotational plastic working method, or the like, and thereby a laminated body comprising the base layer 30, the heat generating layer 40, and the protective layer 50 can be obtained. In the case where a laminated body comprising the base layer 30 and the heat generating layer 40 is to be formed, it can be formed by using metal plates required for the base layer 30 and the heat generating layer 40, and applying the same method as above thereto.

The laminated body in which the thickness of the heat generating layer is controlled into the abovementioned preferred range of 5 to 20 μm, can be obtained by applying the above forming method in which a multi-layered metal plate having two or more non-magnetic metal layers including the base layer 30 and the heat generating layer 40 is subject to plastic deformation working.

Moreover, when the laminated body is being formed, preferably a neutral axis where distortion does not occur when bending deformation occurs, is positioned in the heat generating layer 40. When bending deformation occurs in the laminated body, a shrinkage stress occurs inside of the arc of the bending deformation while an extension stress occurs outside of the arc of the bending deformation. However, in the neutral plane in the thickness direction of the laminated body a neutral axis exists where the extension stress and the shrinkage stress becomes zero (that is, a plane where distortion does not occur).

In order to form the laminated body 10 where the neutral axis is positioned in the heat generating layer 40, for example, if it has the protective layer 50 and the base layer 30, this can be achieved by forming the protective layer 50 and the base layer 30 in the same thickness in a range capable of not causing a secondary obstacle.

(Elastic Layer)

On the surface of the protective layer 50 (the heat generating layer 40 if the protective layer 50 is not provided) may be provided the elastic layer 60. The elastic layer 60 is selected according to the application of the laminated body, and is not specifically limited. However, a thermal resistant elastic layer formed from a silicone rubber or a fluoro rubber is preferred. The elastic layer means a layer formed from a material that can be restored into the original shape, even if it is deformed by an external force application of 100 Pa.

Examples of the silicone rubber include a vinylmethylsilicone rubber, a methylsilicone rubber, a phenylmethylsilicone rubber, a fluorosilicone rubber, and a composite material thereof. Moreover, as the fluoro rubber; a vinylidene fluoride rubber, a tetrafluoroethylene/propylene rubber, a tetrafluoroethylene/perfluoromethylvinylether rubber, a phosphazene rubber, a fluoropolyether rubber, and other fluoro rubbers, may be used. They may be solely used, or plural types thereof may be used in combination.

The thickness of the elastic layer 60 is desirably in a range of 30 to 500 μm, and more desirably in a range of 100 to 300 μm.

Moreover, the hardness of the elastic layer 60 is desirably in a range of A5 to A40 in hardness using a type A durometer, in the durometer hardness test defined by JIS-K6253 (1997). The hardness of the elastic layer 60 can be measured by cutting out the elastic layer 60 from the laminated body. As to the forming method for this elastic layer 60, a ring coating method, a dip coating method, an injection molding method, and the like are applied.

(Resin Layer)

On the surface of the elastic layer 60 (the protective layer 50 if the elastic layer 60 is not provided, and furthermore the heat generating layer 40 if the protective layer 50 is not provided, either) may be provided the resin layer 70. The resin layer 70 is selected according to the application of the laminated body, and is not specifically limited. However, it is desirably formed from, for example, an inorganic material, an organic material, and a composite material thereof.

In particular, it is desirably thermal resistant (hardly decomposed at 300° C.) and superior in mold-releasability. For example, a layer formed from one type or more selected from a fluororesin, a silicone resin, a polyimide resin, a polyamide resin, and a polyamideimide resin is desired.

Examples of the fluororesin include PFA (tetrafluoroethylene-perfluoroalkylvinylether copolymer), PTFE (polytetrafluoroethylene), FEP (tetrafluoroethylene-hexafluoropropylene copolymer), and a composite material thereof. Moreover, examples of the silicone resin include a dimethylsilicone resin, a dimethylethylsilicone resin, a diethylsilicone resin, a diphenylsilicone resin, a dimethylphenylsilicone resin, a diethylphenylsilicone resin, and a composite material thereof. They may be solely used, or plural types thereof may be used in combination. The polyimide resin is obtained by a polymerization reaction between tetracarboxylic dianhydride and a diamine compound in equimolar amounts. Desirably, aromatic tetracarboxylic dianhydride is used as the tetracarboxylic dianhydride, and aromatic diamine is used as the diamine.

The thickness of the resin layer 70 is desirably in a range of 10 to 200 μm, and more desirably in a range of 30 to 100 μm.

As to the forming method for this resin layer 70, an electrostatic powder coating method, a spray coating method, a dip coating method, a centrifugal film forming method, and the like are applied.

The resin layer and the elastic layer formed from the materials described above may contain a lubricant, a plasticizer, conductive particles, an antioxidant, and other additives, as required. Preferably, these additives are previously added into coating liquids for forming the respective layers mentioned above, for use.

The laminated body of the present invention described above can be used basically without any particular limitation, as long as the application is to use a laminated body having at least the base layer and the heat generating layer, and further the protective layer, the resin layer, or the elastic layer. However, it is effective when used for applications particularly where it is required not to increase in the heat capacity, and where heating and cooling are repeated.

Moreover, this laminated body can be suitably used as an intermediate transfer member, a fixing member, a pressure member in a roll-shape, a belt-shape, and the like, in an image forming device such as a printer, a copier, or the like which forms images by toners. Moreover, it is also suitably used in the case where plural sheets are heated and bonded by pressure in lamination working.

<Endless Belt>

The endless belt of the present invention is a belt formed in an endless shape using the laminated body of the present invention, and can be suitably used as an intermediate transfer belt, a fixing belt, and a pressure belt in an image forming device such as a printer, a copier, or the like which forms images by toners.

Figure 2:
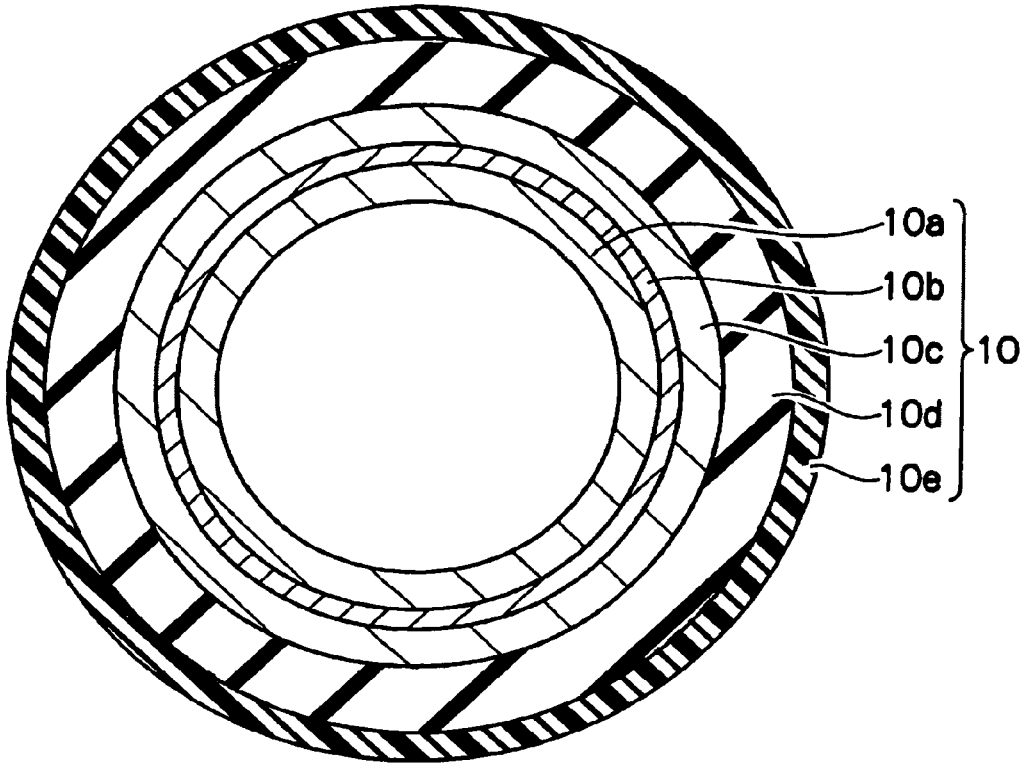
FIG. 2 is a schematic cross-section showing an example of the structure of a fixing belt of the present invention.

FIG. 2 is a schematic cross-section showing an example of the structure of the endless belt of the present invention, showing a 5-layered endless belt.

The endless belt 10 shown in FIG. 2 comprises a base layer 10*a*, a heat generating layer 10*b*, a protective layer 10*c*, an elastic layer 10*d*, and a resin layer 10*e* sequentially from the inner peripheral side.

The constituent materials and the forming methods for the respective layers are in accordance with the contents described for the abovementioned laminated body.

In the endless belt of the present invention, it is needless to say that, methods by means of plastic deformation are desirably used to form metal plates in order to obtain a high strength base layer 10*a* and heat generating layer 10*b* (and furthermore, protective layer 10*c*, if formed), to form the endless belt 10 as a laminated body having the heat generating layer 10*b* of a preferable thickness.

<Fixing Device>

Next is a description of the fixing device using the endless belt of the present invention.

The fixing device of the present invention comprises at least the endless belt (fixing belt) of the present invention including the heat generating layer, a pressure member pressed against the outer peripheral face of the endless belt, and a heat generating member which generates eddy currents in the heat generating layer.

The fixing device of the present invention is not specifically limited as long as it comprises at least the fixing belt, the pressure member, and the heat generating member described above. However, it may have other members or devices such as a cleaning member like a metal blade, and a fixing pad, as required. Moreover, the shape of the pressure member is not specifically limited as long as it is rotatable, and may be in a roll-shape or a belt-shape.

Next is a description of a specific example of the fixing device, using a drawing. However, the heating and fixing device using the endless belt of the present invention is not limited to the structure shown in the following description.

Figure 3:
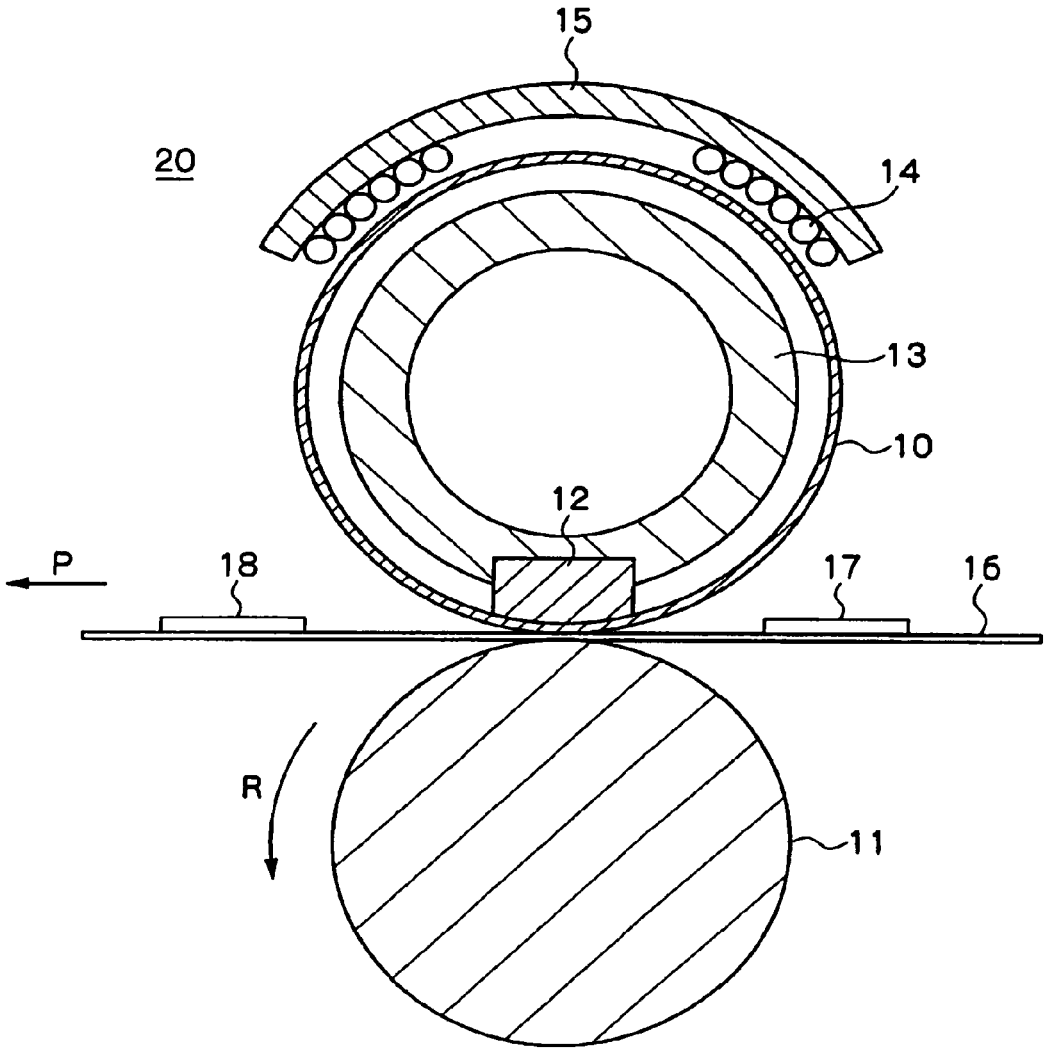
FIG. 3 is a schematic cross-section showing an example of the structure of a fixing device of the present invention.

FIG. 3 is a schematic cross-section showing an example of the structure of the fixing device of the present invention. The fixing device 20 comprises a fixing belt 10, a pressure roller 11, a fixing pad 12, a supporting member 13, electromagnetic induction coils 14 as the heat generating member, and a coil supporting member 15.

The pressure roller 11 is rotatable in the arrow R direction by a drive source (not shown). The fixing belt 10 and the pressure roller 11 are pressed against each other in a manner where the recording media 16 can be inserted therethrough. The fixing belt 10 can be driven to rotate accompanying the rotation of the pressure roller 11 in the arrow R direction. On the inner peripheral face side of the fixing belt 10 is arranged the fixing pad 12 in contact with the inner peripheral face thereof. Furthermore, on the outer peripheral face side of the part in contact with the fixing pad 12 (outer peripheral face of the fixing belt 10) is arranged the pressure roller 11 in contact with the outer peripheral face thereof. Therefore, a pressed zone through which the recording media 16 can be inserted, is formed. The fixing pad 12 is fixed by the supporting member 13 provided on the inner peripheral face of the fixing belt 10.

On the other hand, on the outer peripheral face side of the fixing belt 10 on the opposite side to the fixing pad 12 with respect to the supporting member 13, is provided the electromagnetic induction coils 14 as the heat generating member, separated from the outer peripheral face with a predetermined distance. Moreover, the electromagnetic induction coils 14 are fixed by the coil supporting member 15 provided on the opposite side to the outer peripheral face of the fixing belt 10 with respect to the electromagnetic induction coils 14. The electromagnetic induction coils 14 are connected to a power source (not shown), so that, when an AC current is made to flow through the electromagnetic induction coils 14, a magnetic field crossing (for example, orthogonal to) the outer peripheral face of the fixing belt 10 can be generated in the electromagnetic induction coils 14. The magnetic field is a type of magnetic field whose direction is changed by an excitation circuit (not shown), so that eddy currents can be generated in the heat generating layer included in the fixing belt 10.

Next is a description of a step for fixing an unfixed toner image 17 formed on the surface of the recording media 16 to form an image 18 on the surface of the recording media 16, by the fixing device 20.

The fixing belt 10 is driven to rotate accompanying the rotation of the pressure roller 11 in the arrow R direction, and is exposed to the magnetic field generated by the electromagnetic induction coils 14. At this time, eddy currents are generated in the heat generating layer in the fixing belt 10 by the electromagnetic induction coils 14, and thereby heat is generated. As a result, the outer peripheral face of the fixing belt 10 is heated to a fixing enabling temperature (about 150 to 200° C.).

In the above method, a predetermined region in the outer peripheral face of the fixing belt 10 is heated, and the heated region is moved to the pressed zone with the pressure roller 11 accompanying the rotation of the fixing belt 10. On the other hand, the recording media 16 whose surface is formed with the unfixed toner image 17 is conveyed in the arrow P direction by a conveyance unit (not shown). When the recording media 16 is passing through the pressed zone, the unfixed toner image 17 is heated by contact with the heated region of the fixing belt 10, and fixed onto the surface of the recording media 16. Then, the recording media 16 whose surface is formed with the image 18, is conveyed in the arrow P direction by a conveyance unit (not shown), and discharged from the fixing device 20. Moreover, the predetermined region of the fixing belt 10 applied with the fixing treatment in the pressed zone and having the surface temperature of the outer peripheral face decreased, is moved to the part heated by the electromagnetic induction coils 14 accompanying the rotation of the fixing belt 10, and reheated to be ready for the next fixing treatment.

The electromagnetic induction coils 14 are preferably arranged on the outer peripheral face side of the endless belt 10. Moreover, the distance between the electromagnetic induction coils 14 and the endless belt 10 is selected but is not specifically limited. However, the distance therebetween is preferably set within 5 mm in a non-contact manner.

<Image Forming Device>

Next is a description of the image forming device of the present invention.

The image forming device of the present invention comprises an image carrier, a charging unit which charges a surface of the image carrier, a latent image forming unit which forms a latent image on the surface of the image carrier, a developing unit which develops the formed latent image as a toner image, a transfer unit which transfers the toner image onto a recording media, and a fixing unit which heats and fixes the toner image onto the recording media. The fixing unit comprises the fixing device of the present invention.

Figure 4:
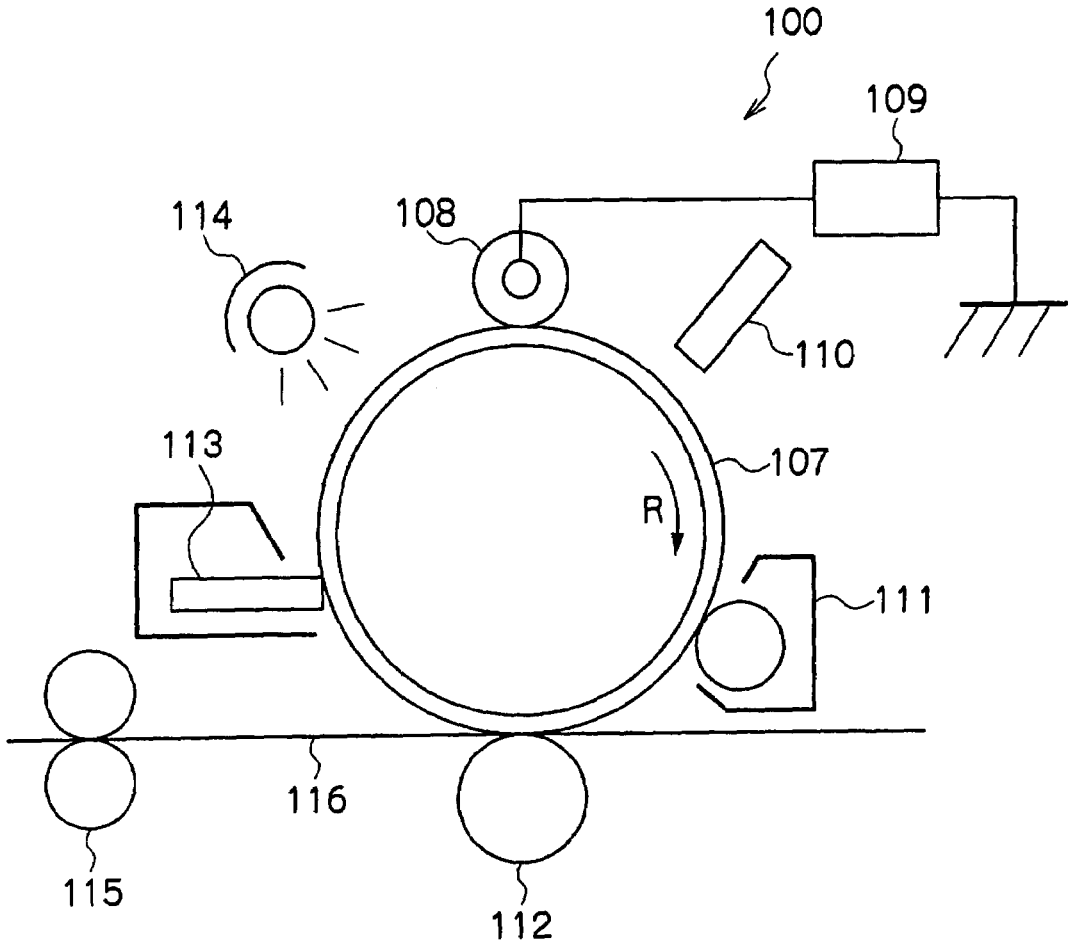
FIG. 4 is a schematic block diagram showing an example of an image forming device of the present invention.

FIG. 4 is a schematic block diagram showing an example of the image forming device of the present invention. The image forming device 100 shown in FIG. 4 comprises: an electrophotographic photoreceptor (image carrier) 107; a charging device (charging unit) 108 which charges the electrophotographic photoreceptor 107 by a contact charging method, a power source 109 which is connected to the charging device 108 to supply power to the charging device 108; an exposure device (latent image forming unit) 110 which exposes the surface of the electrophotographic photoreceptor 107 charged by the charging device 108 with light, to form an electrostatic latent image on the surface of the electrophotographic photoreceptor 107; a developing device (developing unit) 111 which develops the electrostatic latent image formed by the exposure device 110 with toner, to form an toner image; a transfer device (transfer unit) 112 which transfers the toner image formed by the developing device 111 onto a recording media; a cleaning device 113; a de-electrifier 114; and a fixing device (fixing unit) 115. This fixing device 115 is a comprehensive representation of the fixing device 20 described with reference to FIG. 3.

Furthermore, although not shown in FIG. 4, a toner supply device which supplies toner to the developing device 111 is also provided.

The charging device 108 is for charging the surface of the electrophotographic photoreceptor 107 to a predetermined potential by bringing a charging roller into contact with the surface of the electrophotographic photoreceptor 107, and applying a voltage to the electrophotographic photoreceptor 107. When the charging roller is used to charge the electrophotographic photoreceptor 107, the charging roller is applied with a charging bias voltage. This applied voltage may be a direct current voltage or a direct current voltage superimposed with an alternating voltage. In the image forming device of the present invention, instead of the above charging roller method, charging may be performed by a contact charging method using a charging brush, a charging film, a charging tube, or the like. Alternatively, charging may be also performed by a non-contact method using a corotron or a scorotron.

As to the exposure device 110, in the present embodiment, a device which exposes the surface of the electrophotographic photoreceptor 107 with a semiconductor laser, is used. However, instead of this, optical devices which can expose with a light source such as an LED (light emitting diode), a liquid crystal shutter, and the like in a desired image shape, may be used.

As to the developing device 111, a general developing device which develops by means of a contact or non-contact method using a magnetic or non-magnetic mono-component developer, two-component developer, or the like, is used. However, the developing device is not specifically limited, and may be selected according to the purpose.

As to the transfer device 112, a roller-shaped contact charging member is used. Instead of this, a contact type transfer charger using a belt, a film, a rubber blade, or the like, a scorotron transfer charger and a corotron transfer charger utilizing corona discharge, or the like, may be used.

The cleaning device 113 is for removing residual toner adhered onto the surface of the electrophotographic photoreceptor 107 after the transferring step. By so doing, the cleaned electrophotographic photoreceptor 107 is repeatedly used for the above image forming process. As to the cleaning device 113, instead of the illustrated cleaning blade method, methods such as brush cleaning and roll cleaning may be used. However, among them, the cleaning blade method is preferred. Examples of the material of the cleaning blade include a urethane rubber, a neoprene rubber, and a silicone rubber.

Next is a brief description of the image forming process in the image forming device 100.

The surface of the electrophotographic photoreceptor 107 rotating in the arrow R direction is charged by the charging device 108. On the surface of the charged electrophotographic photoreceptor 107 is irradiated laser beams or the like emitting from the exposure device 110 corresponding to the image data, and thereby a latent image is formed. Regarding the latent image formed on the surface of the electrophotographic photoreceptor 107, a toner is applied by a developing unit installed in the developing device 111, thereby visualizing it as a toner image. The toner image formed on the surface of the electrophotographic photoreceptor 107 in the above method is transferred onto a recording media 116 by a bias voltage applied to the electrophotographic photoreceptor 107 and the transfer roller in the pressed zone between the surface of the electrophotographic photoreceptor 107 and the transfer device 112. The transferred toner image is conveyed to the fixing device 115, and fixed onto the recording media 116. This fixing mechanism is the same as described in the above fixing device.

On the other hand, the surface of the electrophotographic photoreceptor 107 after transfer, is cleaned by the cleaning device 113, to be ready for forming a toner image corresponding to the next image data.

Moreover, this image forming device 100 comprises a de-electrifier (erasing light irradiation device) 114 shown in FIG. 4. As a result, a phenomenon where, when the electrophotographic photoreceptor 107 is repeatedly used, residual charge on the electrophotographic photoreceptor 107 is brought into the next image formation cycle can be prevented.

EXAMPLES

Hereunder is a description of Examples of the present invention. However, the present invention is not limited to these Examples.

Example 1

[Endless Belt Having Heat Generating Layer/Base Layer]

Metal plates having a total thickness of 1.0 mm comprising a metal plate (thickness of 0.2 mm) formed from Cu for the heat generating layer, and a metal plate (thickness of 0.8 mm) formed from SUS304 for the base layer are prepared. The bonding faces of the respective plates are ground to remove the oxide coating. Then, the respective metal plates are bonded by means of a roll working in a cold or hot state, to produce a Cu/SUS double-layered metal plate having a total thickness of 0.4 mm. The working distortion of this double-layered metal plate is removed by heat treatment in a nitrogen atmosphere at 700° C.

Next, the double-layered metal plate is molded into a cylindrical container-shape by pressing/deep drawing working. Then, a rotational plastic-working method is performed to obtain a double-layered metal endless belt having an inner diameter of 30 mm, a length of 370 mm, and a wall thickness of 50 μm (10 μm of heat generating layer formed from Cu, and 40 μm of base layer formed from SUS).

The intrinsic resistivity value of the heat generating layer is $1.71\times10^{-6}$ Ωm, and the intrinsic resistivity value of the base layer is $9.7\times10^{-6}$ Ωm. Moreover, the obtained metal seamless belt is cut in the thickness direction. The cross-section is observed with an electron microscope (Trade Name: scanning electron microscope T-200 manufactured by Japan Electron Ltd.). As a result, crystal grains where metal crystals are arranged in the surface direction can be observed.

[Elastic Layer]

Onto the surface of the heat generating layer of the endless belt is applied a liquid silicone rubber (Trade Name: KE1940-35, liquid silicone rubber A35, manufactured by Shin-Etsu Chemical Co., Ltd.) that has been prepared to have a durometer hardness of A35 defined by a type A durometer based on JIS-K6253 (1997), so that the thickness becomes 200 μm, which is then dried to thereby provide a liquid silicone rubber layer in a dry state.

[Releasing Layer]

Onto the surface of the liquid silicone rubber layer in a dry state is applied PFA dispersion (Trade Name: 500CL, manufactured by Du Pont•Mitsui Fluorochemicals Co., Ltd.), so that the thickness becomes 30 μm, which is then baked at 380° C., and thereby an elastic layer made from the silicone rubber and a releasing layer made from PFA are formed to obtain the endless belt.

[Pressure Roll]

A fluororesin tube having an outer diameter of 50 mm, a length of 340 mm, and a thickness of 30 μm, the inner surface of which is coated with an adhesive primer, and a hollow core metal formed from a metal, are set in a mold. A liquid foaming silicone rubber (thickness of 2 mm) is injected between the fluororesin tube and the core, and then the silicone rubber is vulcanized and foamed by a heat treatment (150° C.×2 hrs), to form a pressure roll having a rubber elasticity.

<<Evaluation>>

The endless belt is used as a fixing belt. The fixing belt and the pressure roll are installed in an image forming device (Trade Name: DOCU PRINT C620, manufactured by Fuji Xerox Co., Ltd.) comprising the heating and fixing device 20 shown in FIG. 3. Next, using this image forming device, an electromagnetic induction heating and idling durability evaluation is performed where the fixing belt is continuously idled while being heated by electromagnetic induction, to evaluate the heat generation sustainability of the fixing belt. As a result, even after idling for 200 hours, defective heat generation trouble due to cracking or permanent deformation of the heat generating layer does not occur, and fixing by means of electromagnetic induction heating can be stably performed.

Moreover, the temperature of the endless belt surface when the endless belt is electrically connected to the heat generating member while the endless belt is being rotated in a state where the pressure roll is separated, is measured by a non-contact infrared thermometer (manufactured by Keyence Corporation.). The time from the starting of the electrical connection until the surface temperature becomes 180° C., is measured as the warm-up time, which is 5 seconds.

Example 2

As metal plates for the heat generating layer and the base layer described in the production method of the endless belt in the Example 1, a metal plate (thickness of 0.16 mm) formed from Ag and a metal plate (thickness of 0.84 mm) formed from SUS304 are respectively selected. Then, the same working method is performed to obtain an Ag/SUS double-layered metal endless belt having a wall thickness of 60 μm (10 μm of heat generating layer and 50 μm of base layer). Furthermore, on the surface of this belt are formed the elastic layer and the releasing layer in the same manner as that of Example 1, to obtain the endless belt.

The intrinsic resistivity value of the heat generating layer is $1.68\times10^{-6}$ Ωm, and the intrinsic resistivity value of the base layer is $9.7\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. The warm-up time is 6 seconds.

Example 3

In addition to metal plates for the heat generating layer and the base layer in the production method of the endless belt in Example 1, a metal plate for the protective layer is prepared. A metal plate (thickness of 0.16 mm) formed from SUS304 for the protective layer, a metal plate (thickness of 0.08 mm) formed from Cu for the heat generating layer, and a metal plate (thickness of 0.16 mm) formed from SUS304 for the base layer are respectively selected. Then, the same working method is performed to obtain a SUS/Cu/SUS triple-layered metal endless belt having a wall thickness of 50 μm (20 μm of protective layer, 10 μm of heat generating layer, and 20 μm of base layer). Furthermore, on the surface of this belt are formed the elastic layer and the releasing layer in the same manner as that of Example 1, to obtain the endless belt.

The intrinsic resistivity value of the protective layer is $9.8\times10^{-6}$ Ωm, the intrinsic resistivity value of the heat generating layer is $1.7\times10^{-6}$ Ωm, and the intrinsic resistivity value of the base layer is $9.7\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 300 hours, defective heat generation trouble due to cracking or permanent deformation of the heat generating layer does not occur, and fixing by means of electromagnetic induction heating can be stably performed. The warm-up time is 5 seconds.

Example 4

As metal plates for the protective layer, the heat generating layer, and the base layer described in the production method of the endless belt in the Example 3, a metal plate (thickness of 0.145 mm) formed from SUS304, a metal plate (thickness of 0.11 mm) formed from Al, and a metal plate (thickness of 0.145 mm) formed from SUS304 are respectively selected. Then, the same working method is performed to obtain a SUS/AVSUS triple-layered metal endless belt having a wall thickness of 55 μm (20 μm of protective layer, 15 μm of heat generating layer, and 20 μm of base layer). Furthermore, on the surface of this belt are formed the elastic layer and the releasing layer in the same manner as that of Example 1, to obtain the endless belt.

The intrinsic resistivity value of the protective layer is $9.7\times10^{-6}$ Ωm, the intrinsic resistivity value of the heat generating layer is $2.7\times10^{-6}$ Ωm, and the intrinsic resistivity value of the base layer is $9.8\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 300 hours, defective heat generation trouble due to cracking or permanent deformation of the heat generating layer does not occur, and fixing by means of electromagnetic induction heating can be stably performed. The warm-up time is 5 seconds.

Example 5

As metal plates for the heat generating layer and the base layer described in the production method of the endless belt in the Example 1, a metal plate (thickness of 0.04 mm) formed from Cu and a metal plate (thickness of 0.36 mm) formed from SUS304 are respectively selected. Then, the same working method is performed to obtain a Cu/SUS double-layered metal endless belt having a wall thickness of 56 μm (6 μm of heat generating layer and 50 μm of base layer). Furthermore, on the surface of this belt are formed the elastic layer and the releasing layer in the same manner as that of Example 1, to obtain the endless belt.

The intrinsic resistivity value of the heat generating layer is $1.7\times10^{-6}$ Ωm, and the intrinsic resistivity value of the base layer is $9.8\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. The warm-up time is 6 seconds.

Example 6

As metal plates for the heat generating layer and the base layer described in the production method of the endless belt in the Example 1, a metal plate (thickness of 0.16 mm) formed from Cu and a metal plate (thickness of 0.24 mm) formed from SUS304 are respectively selected. Then, the same working method is performed to obtain a Cu/SUS double-layered metal endless belt having a wall thickness of 49 μm (19 μm of heat generating layer and 30 μm of base layer). Furthermore, on the surface of this belt are formed the elastic layer and the releasing layer in the same manner as that of Example 1, to obtain the endless belt.

The intrinsic resistivity value of the heat generating layer is $1.8\times10^{-6}$ Ωm, and the intrinsic resistivity value of the base layer is $9.6\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. The warm-up time is 5 seconds.

Example 7

As metal plates for the heat generating layer and the base layer described in the production method of the endless belt in the Example 1, a metal plate (thickness of 0.07 mm) formed from Cu and a metal plate (thickness of 0.33 mm) formed from SUS304 are respectively selected. Then, the same working method is performed to obtain a Cu/SUS double-layered metal endless belt having a wall thickness of 48 μm (8 μm of heat generating layer and 40 μm of base layer). Furthermore, on the surface of this belt are formed the elastic layer and the releasing layer in the same manner as that of Example 1, to obtain the endless belt.

The intrinsic resistivity value of the heat generating layer is $1.8\times10^{-6}$ Ωm, and the intrinsic resistivity value of the base layer is $9.7\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. The warm-up time is 5 seconds.

Example 8

As metal plates for the heat generating layer and the base layer described in the production method of the endless belt in the Example 1, a metal plate (thickness of 0.1 mm) formed from Cu and a metal plate (thickness of 0.3 mm) formed from SUS304 are respectively selected. Then, the same working method is performed to obtain a Cu/SUS double-layered metal endless belt having a wall thickness of 56 μm (14 μm of heat generating layer and 42 μm of base layer). Furthermore, on the surface of this belt are formed the elastic layer and the releasing layer in the same manner as that of Example 1, to obtain the endless belt.

The intrinsic resistivity value of the heat generating layer is $1.7\times10^{-6}$ Ωm, and the intrinsic resistivity value of the base layer is $9.8\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. The warm-up time is 6 seconds.

Example 9

As metal plates for the heat generating layer and the base layer described in the production method of the endless belt in the Example 1, a metal plate (thickness of 0.03 mm) formed from Cu and a metal plate (thickness of 0.37 mm) formed from SUS304 are respectively selected. Then, the same working method is performed to obtain a Cu/SUS double-layered metal endless belt having a wall thickness of 48 μm (4 μm of heat generating layer and 44 μm of base layer). Furthermore, on the surface of this belt are formed the elastic layer and the releasing layer in the same manner as that of Example 1, to obtain the endless belt.

The intrinsic resistivity value of the heat generating layer is $1.8\times10^{-6}$ Ωm, and the intrinsic resistivity value of the base layer is $9.6\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, cracking of the heat generating layer does not occur. However, distortion of the endless belt slightly occurs due to excessive heat generation of the heat generating layer. The warm-up time is 5 seconds.

Example 10

As metal plates for the heat generating layer and the base layer described in the production method of the endless belt in the Example 1, a metal plate (thickness of 0.13 mm) formed from Cu and a metal plate (thickness of 0.27 mm) formed from SUS304 are respectively selected. Then, the same working method is performed to obtain a Cu/SUS double-layered metal endless belt having a wall thickness of 63 μm (21 μm of heat generating layer and 42 μm of base layer). Furthermore, on the surface of this belt are formed the elastic layer and the releasing layer in the same manner as that of Example 1, to obtain the endless belt.

The intrinsic resistivity value of the heat generating layer is $1.8\times10^{-6}$ Ωm, and the intrinsic resistivity value of the base layer is $9.7\times10^{-6}$ Ωm. Moreover, the cross-section of the obtained metal endless belt is observed in the method shown in Example 1. As a result, crystal grains where metal crystals are arranged in the surface direction can be observed.

Next, an electromagnetic induction heating and idling durability evaluation shown in Example 1 is performed. As a result, even after idling for 200 hours, cracking of the heat generating layer does not occur. However, defective heat generation slightly occurs in the heat generating layer. A printing operation is performed using J-sheets (A4 size) manufactured by Fuji Xerox Co., Ltd. as a recording media, which shows a few images where the fixity of the toner image transferred onto the recording media is not satisfactory (fixing is not sufficient) compared to the Examples 1 to 8. The warm-up time is 6 seconds.

Comparative Example 1

A commercially available polyimide precursor solution (Trade name: U-VARNISH-S, manufactured by Ube Industries. Ltd.) is coated on the surface of a cylindrical stainless steel mold having an outer diameter of 30 mm by a dip method, and thereby a coated film is formed. Next, this coated film is dried at 100° C. for 30 minutes to evaporate the solvent in the coated film, which is then baked at 380° C. for 30 minutes to effect imidization, and thereby a polyimide film having a thickness of 60 μm is formed. After cooling down, the polyimide film is peeled off from the surface of the stainless steel mold, so as to obtain a thermal resistant base substance (thermal resistant resin layer) formed from polyimide having an inner diameter of 30 mm, a thickness of 75 μm, and a length of 370 mm. Next, on the outer peripheral face of this thermal resistant base substance is formed a nonelectrolytic Cu plating film having a thickness of 0.3 μm as a metal layer. This plating film is used as an electrode to form an electrolytic copper plating film having a thickness of 10 μm. Furthermore, the elastic layer and the releasing layer are formed in the manner shown in the Example 1, to obtain the endless belt.

Next, an electromagnetic induction heating and idling durability evaluation shown in Example 1 is performed. As a result, after idling for 50 hours, cracking and defective heat generation trouble occur in the heat generating layer.

Comparative Example 2

An endless belt having the same structure as that of Comparative Example 1 is obtained except that a nonelectrolytic Ni plating film having a thickness of 0.3 μm is formed as the heat generating layer of the endless belt shown in Comparative Example 1, and this plating film is used as an electrode to form an electrolytic nickel plating film having a thickness of 15 μm.

Next, an electromagnetic induction heating and idling durability evaluation shown in Example 1 is performed. As a result, after idling for 30 hours, cracking and defective heat generation trouble occur in the heat generating layer.

Comparative Example 3

As metal plates for the heat generating layer and the base layer described in the production method of the endless belt in the Example 1, a metal plate (thickness of 0.1 mm) formed from Cu and a metal plate (thickness of 0.8 mm) formed from ferrite stainless steel 310 are respectively selected. Then, the same working method is performed to obtain a Cu/ferrite stainless steel double-layered metal endless belt having a wall thickness of 45 μm (5 μm of heat generating layer and 40 μm of base layer). Furthermore, on the surface of this belt are formed the elastic layer and the releasing layer in the same manner as that of Example 1, to obtain the endless belt.

Next, an electromagnetic induction heating and idling durability evaluation shown in Example 1 is performed. As a result, even after idling for 200 hours, defective heat generation trouble due to cracking or permanent deformation of the heat generating layer does not occur, and fixing by means of electromagnetic induction heating can be stably performed. However, the warm-up time is as long as 25 seconds, which is a problem for use.

Hereunder, preferred aspects of the present invention are shown. Firstly, the laminated body of the present invention comprises:

<1> a heat generating layer having crystal grains of a first non-magnetic metal, and a base layer having a second non-magnetic metal which is different from the first non-magnetic metal. By having this structure, compared to the case not having the present structure, cracking does not occur due to repetitive deformation in use and heat generation by means of electromagnetic induction can be more efficiently performed.

<2> The thickness of the heat generating layer in the laminated body according to the aforementioned <1> is preferably 5 to 20 μm. By having this structure, compared to the case not having the present structure, heat generation by means of electromagnetic induction can be more efficiently performed.

<3> The thickness of the heat generating layer in the laminated body according to the aforementioned <1> is preferably 7 to 15 μm. By having this structure, compared to the case not having the present structure, heat generation by means of electromagnetic induction can be more efficiently performed.

<4> The thickness of the heat generating layer in the laminated body according to the aforementioned <1> is preferably 8 to 12 μm. By having this structure, compared to the case not having the present structure, heat generation by means of electromagnetic induction can be more efficiently performed.

<5> The crystal grains in the laminated body according to any one of the aforementioned <1> through <4> are preferably arranged in the surface direction of the heat generating layer. By having this structure, compared to the case not having the present structure, the durability against cracking occurrence in the heat generating layer can be more improved.

<6> The intrinsic resistivity value of the heat generating layer in the laminated body according to any one of the aforementioned <1> through <5> is preferably $2.7\times10^{-6}$ Ωm or less. By having this structure, compared to the case not having the present structure, heat generation by means of electromagnetic induction can be more efficiently performed.

<7> The intrinsic resistivity value of the heat generating layer in the laminated body according to any one of the aforementioned <1> through <5> is preferably $1.0\times10^{-6}$ Ωm or more and $2.5\times10^{-6}$ Ωm or less. By having this structure, compared to the case not having the present structure, heat generation by means of electromagnetic induction can be more efficiently performed.

<8> The intrinsic resistivity value of the heat generating layer in the laminated body according to any one of the aforementioned <1> through <5> is preferably $1.2\times10^{-6}$ Ωm or more and $2.2\times10^{-6}$ Ωm or less. By having this structure, compared to the case not having the present structure, heat generation by means of electromagnetic induction can be more efficiently performed.

<9> The first non-magnetic metal in the laminated body according to any one of the aforementioned <1> through <8> is preferably at least one type selected from gold, silver, copper, aluminum, and an alloy containing these. By having this structure, compared to the case not having the present structure, heat generation by means of electromagnetic induction can be more efficiently performed.

<10> The intrinsic resistivity value of the base layer in the laminated body according to any one of the aforementioned <1> through <9> is preferably more than $2.7\times10^{-6}$ Ωm. By having this structure, compared to the case not having the present structure, heat generation by means of electromagnetic induction can be more efficiently performed.

<11> The intrinsic resistivity value of the base layer in the laminated body according to any one of the aforementioned <1> through <9> is preferably $5.0\times10^{-6}$ Ωm or more and $5.0\times10^{-5}$ μm or less. By having this structure, compared to the case not having the present structure, heat generation by means of electromagnetic induction can be more efficiently performed.

<12> The intrinsic resistivity value of the base layer in the laminated body according to any one of the aforementioned <1> through <9> is preferably $7.0\times10^{-6}$ Ωm or more and $3.0\times10^{-5}$ Ωm or less. By having this structure, compared to the case not having the present structure, heat generation by means of electromagnetic induction can be more efficiently performed.

<13> The second non-magnetic metal in the laminated body according to any one of the aforementioned <1> through <12> is at least one type selected from stainless steel, and an alloy containing stainless steel. By having this structure, compared to the case not having the present structure, the durability against cracking occurrence in the heat generating layer can be more improved.

<14> The heat generating layer and the base layer in the laminated body according to any one of the aforementioned <1> through <13> are preferably formed by means of plastic deformation. By having this structure, compared to the case not having the present structure, the durability against cracking occurrence in the heat generating layer can be more improved.

<15> The laminated body according to any one of the aforementioned <1> through <14> preferably has a protective layer containing a third non-magnetic metal which is different from the first non-magnetic metal, on the surface of the heat generating layer that is opposite to the surface provided with the base layer. By having this structure, compared to the case not having the present structure, the durability against cracking occurrence in the heat generating layer can be more improved.

<16> The protective layer in the laminated body according to the aforementioned <15> is preferably formed by means of plastic deformation. By having this structure, compared to the case not having the present structure, the durability against cracking occurrence in the heat generating layer can be more improved.

<17> The laminated body according to any one of the aforementioned <1> through <16> preferably has an elastic layer on the surface of the heat generating layer that is opposite to the surface provided with the base layer. By having this structure, compared to the case not having the present structure, scratch resistance on the surface can be improved, and shock-resistance can be imparted due to having superior elasticity.

<18> The laminated body according to any one of the aforementioned <1> through <17> preferably has a resin layer on the surface of the heat generating layer that is opposite to the surface provided with the base layer. By having this structure, compared to the case not having the present structure, scratch resistance of the surface can be improved, and a superior mold-releasability of the surface can be imparted.

<19> In the laminated body according to any one of the aforementioned <1> through <18>, preferably a neutral axis where distortion does not occur when bending deformation occurs, is positioned in the heat generating layer. By having this structure, compared to the case not having the present structure, durability against cracking occurrence in the heat generating layer can be more improved.

Moreover, in the endless belt of the present invention,

<20> the laminated body according to any one of the aforementioned <1> through <19> is formed in an endless shape. By having this structure, compared to the case not having the present structure, cracking with respect to rotational driving or the like does not occur in the heat generating layer, and heat generation by means of electromagnetic induction can be more efficiently performed.

Moreover, the fixing device of the present invention comprises:

<21> an endless belt according to the aforementioned <20>, a pressure member which presses an outer peripheral face of the endless belt, and a heat generating member which generates eddy currents in the heat generating layer of the endless belt by means of electromagnetic induction. By having this structure, compared to the case not having the present structure, even in repetitive usage, satisfactory fixity by means of heating in the electromagnetic induction method, can be maintained.

<22> The heat generating member in the fixing device according to the aforementioned <21> is preferably provided on the outer peripheral face side of the endless belt. By having this structure, compared to the case not having the present structure, a decrease in the electromagnetic induction property due to an increase in the temperature inside the endless belt at the time of heating and fixing, followed by an increase in the temperature of the heat generating member, can be effectively suppressed, and satisfactory heat generation by means electromagnetic induction can be maintained for a long time.

Moreover, the image forming device of the present invention comprises

<23> an image carrier, a charging unit which charges a surface of the image carrier, a latent image forming unit which forms a latent image on the surface of the image carrier, a developing unit which develops the formed latent image as a toner image, a transfer unit which transfers the toner image onto a recording medium, and a fixing unit which fixes the toner image onto the recording medium. The fixing unit comprises the fixing device according to the aforementioned <21> or <22>. By having this structure, compared to the case not having the present structure, a satisfactorily fixed high quality image can be obtained for a long time.

What is claimed is:

1. A laminated body comprising a heat generating layer having crystal grains of a first non-magnetic metal, and a base layer having a second non-magnetic metal that is different from the first non-magnetic metal, wherein the crystal grains are arranged in a surface direction of the heat generating layer.

2. The laminated body according to claim 1, wherein a thickness of the heat generating layer is about 5 to about 20 μm.

3. The laminated body according to claim 1, wherein a thickness of the heat generating layer is about 7 to about 15 μm.

4. The laminated body according to claim 1, wherein a thickness of the heat generating layer is about 8 to about 12 μm.

5. The laminated body according to claim 1, wherein an intrinsic resistivity value of the heat generating layer is about $2.7\times10^{-6}$ Ωm or less.

6. The laminated body according to claim 1, wherein an intrinsic resistivity value of the heat generating layer is about $1.0\times10^{-6}$ Ωm to about $2.5\times10^{-6}$ Ωm.

7. The laminated body according to claim 1, wherein an intrinsic resistivity value of the heat generating layer is about $1.2\times10^{-6}$ Ωm to about $2.2\times10^{-6}$ Ωm.

8. The laminated body according to claim 1, wherein the first non-magnetic metal is at least one selected from gold, silver, copper, aluminum, or an alloy containing at least one selected from the group consisting of gold, silver, copper and aluminum.

9. The laminated body according to claim 1, wherein an intrinsic resistivity value of the base layer is more than about $2.7\times10^{-6}$ Ωm.

10. The laminated body according to claim 1, wherein the second non-magnetic metal is at least one selected from stainless steel, and an alloy containing stainless steel.

11. The laminated body according to claim 1, wherein the heat generating layer and the base layer are formed by being subjected to plastic deformation.

12. The laminated body according to claim 1, comprising at least one layer selected from an elastic layer and a resin layer, on the surface of the heat generating layer that is opposite to the surface provided with the base layer.

13. An endless belt, comprising the laminated body according to claim 1 being formed in an endless shape.

14. A fixing device comprising:

the endless belt according to claim 13;

a pressure member that presses an outer peripheral face of the endless belt; and a heat generating member that generates heat in the heat generating layer of the endless belt by means of electromagnetic induction.

15. The fixing device according to claim 14, wherein the heat generating member is provided on the outer peripheral face side of the endless belt.

16. An image forming device comprising: an image carrier, a charging unit that charges a surface of the image carrier, a latent image forming unit that forms a latent image on the surface of the image carrier, a developing unit that develops the formed latent image as a toner image, a transfer unit that transfers the toner image onto a recording medium, and a fixing unit that fixes the toner image onto the recording medium, and the fixing device according to claim 14 is used as the fixing unit.

17. A laminated body comprising a heat generating layer having crystal grains of a first non-magnetic metal, and a base layer having a second non-magnetic metal that is different from the first non-magnetic metal, wherein an intrinsic resistivity value of the base layer is about $5.0\times10^{-6}$ Ωm to about $5.0\times10^{-6}$ Ωm.

18. A laminated body comprising a heat generating layer having crystal grains of a first non-magnetic metal, and a base layer having a second non-magnetic metal that is different from the first non-magnetic metal, wherein an intrinsic resistivity value of the base layer is about $7.0\times^{10-6}$ Ωm to about $3.0\times10^{-5}$ Ωm.

19. A laminated body comprising a heat generating layer having crystal grains of a first non-magnetic metal, and a base layer having a second non-magnetic metal that is different from the first non-magnetic metal, a protective layer formed on the surface of the heat generating layer that is opposite to the surface provided with the base layer, and containing a third non-magnetic metal that is different from the first non-magnetic metal.

20. The laminated body according to claim 19, wherein the protective layer is formed by being subjected to plastic deformation.

* * * * *